US009997854B2

(12) United States Patent
Kobayashi et al.

(10) Patent No.: US 9,997,854 B2
(45) Date of Patent: Jun. 12, 2018

(54) MOVABLE CONNECTOR

(71) Applicant: IRISO ELECTRONICS CO., LTD., Kanagawa (JP)

(72) Inventors: Hiroaki Kobayashi, Kanagawa (JP); Yoshiyuki Ogura, Kanagawa (JP); Koji Kuniyoshi, Kanagawa (JP); Daichi Shimba, Kanagawa (JP)

(73) Assignee: IRISO ELECTRONICS CO., LTD., Kanagawa (JP)

( * ) Notice: Subject to any disclaimer, the term of this patent is extended or adjusted under 35 U.S.C. 154(b) by 0 days. days.

(21) Appl. No.: 15/413,687

(22) Filed: Jan. 24, 2017

(65) Prior Publication Data

US 2017/0222346 A1 Aug. 3, 2017

(30) Foreign Application Priority Data

Feb. 2, 2016 (JP) ..... 2016-018368

(51) Int. Cl.

| | |
|---|---|
| ***H01R 12/91*** | (2011.01) |
| ***H01R 13/187*** | (2006.01) |
| ***H01R 13/502*** | (2006.01) |
| ***H01R 13/415*** | (2006.01) |

(Continued)

(52) U.S. Cl.

CPC ..... *H01R 13/187* (2013.01); *H01R 12/712* (2013.01); *H01R 12/91* (2013.01); *H01R 13/415* (2013.01); *H01R 13/502* (2013.01); *H01R 12/57* (2013.01)

(58) Field of Classification Search

CPC .. H01R 13/415; H01R 13/187; H01R 13/502; H01R 12/91; H01R 12/53

See application file for complete search history.

(56) References Cited

U.S. PATENT DOCUMENTS 6,347,950 B1 * 2/2002 Yokoyama ..... H01R 13/6315 439/248
9,022,801 B2 * 5/2015 Endo ..... H01R 13/533 439/527
9,799,971 B2 * 10/2017 Ninomiya ..... H01R 12/52

(Continued)

FOREIGN PATENT DOCUMENTS

JP 2012-156090 A 8/2012
JP 5336679 B1 8/2013

(Continued)

OTHER PUBLICATIONS

Office Action from Japanese Patent App. No. 2016-018368 (dated Jun. 9, 2017).

(Continued)

*Primary Examiner* — Briggitte R Hammond
(74) *Attorney, Agent, or Firm* — Cermak Nakajima & McGowan LLP; Tomoko Nakajima

(57) ABSTRACT

Connection reliability of terminals in a movable connector is enhanced. The movable connector includes a fixed housing having an abutment receiving portion and a movable housing having an abutment portion. When a pin terminal is fitted and inserted, the abutment portion abuts on the abutment receiving portion. This prevents arcuate curved deformation of the movable housing, and restricts a movable piece of a terminal at a center portion of the movable housing from being slightly stretched from the beginning of fitting and from constantly receiving load.

13 Claims, 9 Drawing Sheets

(51) Int. Cl.
*H01R 12/71* (2011.01)
*H01R 12/57* (2011.01)

(56) References Cited

U.S. PATENT DOCUMENTS

| | | | | |
|---|---|---|---|---|
| 2006/0258199 | A1* | 11/2006 | Umehara ..... | H01R 13/33<br>439/247 |
| 2014/0342614 | A1* | 11/2014 | Yukutake ..... | H01R 13/46<br>439/626 |
| 2015/0064935 | A1 | 3/2015 | Funayama et al. | |

FOREIGN PATENT DOCUMENTS

| | | | |
|---|---|---|---|
| JP | 2014-067706 | A | 4/2014 |
| JP | 2014-165066 | A | 9/2014 |
| JP | 2014-229407 | A | 12/2014 |
| JP | 2015-153503 | A | 8/2015 |

OTHER PUBLICATIONS

European Search Report for European Patent App. No. 17152631.2 (dated Mar. 9, 2017).

* cited by examiner

MOVABLE CONNECTOR

BACKGROUND OF THE INVENTION

1. Field of the Invention

The present invention relates to an electric connector, and more particularly, to a movable connector including a movable housing.

2. Description of the Related Art

A bottom entry connector is known as a connector that conductively connects a connection object to a circuit on a substrate. In this connector, a connection object, for example, pin terminals of a pin header are conductively connected by being inserted into a housing from a back surface opposite from a mounting surface of a substrate. The substrate has through holes through which the pin terminals are to be inserted. In such a bottom entry connector, since the insertion holes for the pin terminals are open in the bottom surface of the housing, the housing is accurately mounted at a predetermined position on the substrate. If the center axes of the insertion holes and the pin terminals are not aligned, it is difficult to smoothly insert the pin terminals. If the pin terminals are forcibly inserted, load is applied to contact portions of the terminals and soldered portions connected to the substrate.

Accordingly, it is known that a bottom entry connector is formed by a movable connector (see, for example, Japanese Unexamined Patent Application Publication No. 2014-165066). This bottom entry connector includes a fixed housing to be disposed on a mounting surface of a substrate, and the fixed housing has a receiving part opening toward through holes in the substrate to receive a movable housing. In the receiving part, the movable housing is disposed in a floating state with a gap between the movable housing and an inner wall that defines the receiving part. The movable housing is displaceably supported by spring portions of terminals fixed to both the fixed housing and the movable housing. When the center axes of insertion holes of the movable housing and pin terminals are not aligned, the movable housing receives the insertion force of the pin terminals, and is displaced by the soft spring portions to remove misalignment between the center axes. Thus, it is possible to smoothly insert the pin terminals and to reduce the load applied to contact portions and soldered portions of the terminals.

In the movable connector including the movable housing, a stopper structure for stopping excessive displacement of the movable housing is generally provided, for example, to protect the terminals. Such a stopper structure is formed by a contact structure between the movable housing and the fixed housing, and is composed of, for example, abutment projections projecting sideward from side walls of the movable housing in the longitudinal direction and abutment receiving portions provided inside the fixed housing.

When a connection object is inserted in such a movable housing, the movable housing receives the insertion force of the connection object, and is thereby displaced until the abutment projections abut on the abutment receiving portions. Even after the abutment projections abut on the abutment receiving portions, insertion of the connection object is continued until the connection object reaches a predetermined fitting position. At this time, the movable housing continues to receive the insertion force of the connection object by the abutment projections at both ends, and a longitudinal center portion of the movable housing is curved and deformed to project in an arcuate form in the inserting and fitting direction of the connection object. Then, in the terminals at the center portion of the movable housing, spring portions are slightly stretched from the beginning of fitting, and load is constantly applied thereto. Hence, fatigue durability becomes lower than the designed value. If the movable housing to be displaced by, for example, vibration continues to be elastically supported in this state, the spring portions may be broken. This deteriorates connection reliability.

When the movable housing is curved and deformed in the arcuate form, as described above, the fitting length by which the connection object is fitted to the terminals becomes short in the center portion of the movable housing. Hence, the designed fitting length is not obtained, and this may also deteriorate connection reliability.

SUMMARY OF THE INVENTION

The present invention has been made in the context of the above-described related art. An object of the invention is to enhance connection reliability of terminals in a movable connector.

To achieve the above object, the present invention provides a movable connector configured as follows.

A movable connector according to an aspect of the present invention includes an outer housing having a receiving chamber therein, an inner housing disposed in the receiving chamber and having an insertion hole for a connection object, and at least one terminal having a spring portion that supports the inner housing displaceably relative to the outer housing. The inner housing has at least one abutment portion in a distal end portion thereof in an inserting and fitting direction of the connection object. The outer housing has an opposed wall opposed to the at least one abutment portion, and the opposed wall has an abutment receiving portion on which the at least one abutment portion abuts when the connection object is fitted and inserted.

In the movable connector according to the aspect of the present invention, the inner housing has the abutment portion in the distal end portion in the inserting direction of the connection object, and the outer housing has the opposed wall opposed to the abutment portion. The opposed wall has the abutment receiving portion on which the abutment portion abuts when the connection object is fitted and inserted. Hence, when the connection object is fitted and inserted, the abutment portion located in the distal end portion of the inner housing abuts on the abutment receiving portion of the outer housing. This can suppress arcuate curved deformation at the distal end position of the displaced inner housing, and can restrict the movable piece of the terminal from being slightly stretched from the beginning of fitting of the connection object and from constantly receiving load. Therefore, according to the aspect of the present invention, both high flexibility and high fatigue durability of the movable piece can be achieved. Moreover, since the arcuate curved deformation of the inner housing can be suppressed, the connection object can be properly and conductively connected with a predetermined fitting length.

In the above-described movable connector according to the aspect of the present invention, a stopper function of stopping displacement of the inner housing in the inserting and fitting direction (Z-direction) can be fulfilled by the abutment portion and the abutment receiving portion described above. On the other hand, as a stopper function of stopping displacement in an arrangement direction of the terminal (X-direction), a direction (Y-direction) orthogonal to the arrangement direction, and a removing direction (Z-direction) of the connection object, another abutment portion and another abutment receiving portion may be provided in the outer housing and the inner housing, respectively.

Preferably, the outer housing has a recessed shape in which the receiving chamber is provided, and the opposed wall is formed by a wall that forms a bottom surface of the recessed receiving chamber.

According to this, the outer housing is recessed, and the wall that forms the bottom surface of the recessed receiving chamber and serves as the opposed wall can be surrounded by a peripheral wall. Hence, the peripheral wall can reliably support the opposed wall on which the abutment portion of the inner housing abuts and insertion force is applied.

Preferably, the at least one abutment portion of the inner housing includes a plurality of abutment portions spaced from each other.

According to this, since the plural abutment portions abut on the abutment receiving portion of the outer housing, the inner housing can stably maintain its right posture without obliquely tilting. This allows the connection object to be properly inserted.

Preferably, the at least one terminal of the movable connector includes a plurality of terminals.

The movable connector according to the aspect of the present invention has the effect of suppressing arcuate curved deformation of the inner housing when the connection object is fitted and inserted. This achieves both flexibility and fatigue durability of spring portions by preventing extra load from being applied to spring portions of the terminals from the beginning of fitting. While this is effective when the movable connector is a multipolar connector that is long and easily bendable, it is also effective for a connector having only one terminal in terms of obtaining a proper fitting state between the terminals and the connection object and achieving both flexibility and fatigue durability of the spring portions. Therefore, the above-described movable connector or a movable connector to be described later can be applied to connectors having one or more terminals.

Preferably, the abutment receiving portion has a contact surface on which the at least one abutment portion abuts even when the inner housing is displaced and deviates.

According to this, even when the inner housing is displaced and deviates in the direction intersecting the inserting and fitting direction of the connection object during fitting and insertion of the connection object, the abutment portion abuts on the abutment receiving portion. Hence, arcuate curved deformation can be reliably suppressed even when the inner housing is displaceable three-dimensionally.

Preferably, the outer housing has a flat surface on an outer surface of the opposed wall.

According to this, the flat surface can be utilized as a portion to be sucked by an automatic mounting suction nozzle to cope with automatic mounting.

Preferably, the at least one abutment portion is provided as a projecting wall having a length along an arrangement direction of the at least one terminal.

Since the abutment portion is the projecting wall having the length along the arrangement direction of the terminal, it abuts on the outer housing for a predetermined length along the arrangement direction of the terminal in the inner housing, and this can suppress arcuate curved deformation of the inner housing.

For example, when the inner housing is rectangular, the projecting wall of the abutment portion can be formed as a projecting wall extending in the longitudinal direction of the inner housing. When the inner housing is square, the projecting wall can be formed as a projecting wall extending along one side of the inner housing. It is only necessary that the length of the abutment portion should suppress arcuate deformed deformation of the inner housing, and the length may be determined by any of a manner in which the abutment portion is columnar, a manner in which a plurality of abutment portions are discretely provided in the form of a broken line, and a manner in which one linear abutment portion is provided. Alternatively, some of the manner may be combined.

Preferably, the at least one abutment portion is provided as projecting walls at a plurality of positions in an arrangement direction of the at least one terminal.

According to this, the abutment portion abuts on the outer housing at a plurality of positions in the arrangement direction of the terminal. This can suppress arcuate curved deformation of the inner housing.

Here, "a plurality of positions in the arrangement direction of the at least one terminal" means that, when one terminal is provided, the plurality of positions include a plurality of positions around the terminal, and that, when a plurality of terminals are provided, the plurality of positions include both outer positions at both ends of an array of terminals and positions between adjacent terminals.

It is only necessary that such projecting walls should be provided at "a plurality of positions" described above, and the projecting wall at each position can have various shapes such as a columnar shape, a linear shape, or a broken line shape.

Preferably, the inner housing has at least one terminal holding portion, and the projecting wall or the projecting walls are located adjacent to the at least one terminal holding portion.

Since the projecting wall or the projecting walls are adjacent to the terminal holding portion, arcuate curved deformation of the inner housing can be reliably suppressed at the terminal holding position, that is, at the position near the terminal.

Preferably, the at least one terminal holding portion includes a plurality of terminal holding portions, and the projecting wall or the projecting walls are provided between the adjacent terminal holding portions.

Since the projecting wall or the projecting walls are provided between the adjacent terminal holding portions, spaces defined by the adjacent projecting walls can be formed on extensions of the terminal holding portions. These spaces can serve as heat radiation passages through which heat from the abutment portion dissipates. Therefore, the movable connector can be applied to the use of a large current. In the connector for the use of a large current, it is necessary to take the withstand voltage into consideration so that discharging does not occur between the adjacent terminals. However, in the movable connector of the aspect of the invention, the projecting wall or the projecting walls provided between the adjacent terminal holding portions can improve insulation and this can increase the withstand voltage.

Preferably, the inner housing has a hole-shaped terminal holding portion, and the outer housing has a hole at a position on an extension of the terminal holding portion of the inner housing.

According to this, heat generated from the terminal can be dissipated from the inside of the outer housing through the hole located on the extension of the terminal holding portion in the inner housing. Therefore, the movable connector can be applied to the use of a large current.

Preferably, the at least one terminal has a contact portion to be in conductive contact with the connection object, and a contact holding force with which the contact portion is in pressure contact with the connection object to fix a contact position is more than a displacement load of the spring portion by which the contact portion deviates relative to the connection object in an inserting or removing direction of the connection object.

According to this, even when the inner housing is displaced, the contact holding force of the contact portion for the connection object does not yield to the displacement load of the spring portion, and the connection object does not deviate relative to the contact portion. For this reason, fretting of the contact portion is suppressed, and the contact position with the connection object is continuously maintained. Therefore, even when the inner housing is displaced, the occurrence of various troubles resulting from the fretting of the contact portion (for example, peeling of plating from the connection object and generation of metal shavings) can be suppressed.

According to the movable connector of the present invention, when the connection object is fitted and inserted, the abutment portion located in the distal end portion of the inner housing abuts on the outer housing. This can prevent arcuate curved deformation of the inner housing when the connection object is fitted and inserted. For this reason, the connection object can be properly and conductively connected, and both high flexibility and high fatigue durability of each movable piece can be achieved. Thus, connection reliability of the terminal in the movable connector can be enhanced.

DESCRIPTION OF THE PREFERRED EMBODIMENTS

A movable connector according to an embodiment of the present invention will be described below with reference to the drawings. While a connector 10 of the embodiment is the bottom entry connector described in conjunction with the related art, the application of the movable connector of the present invention is not limited to the bottom entry connector.

Figure 1:
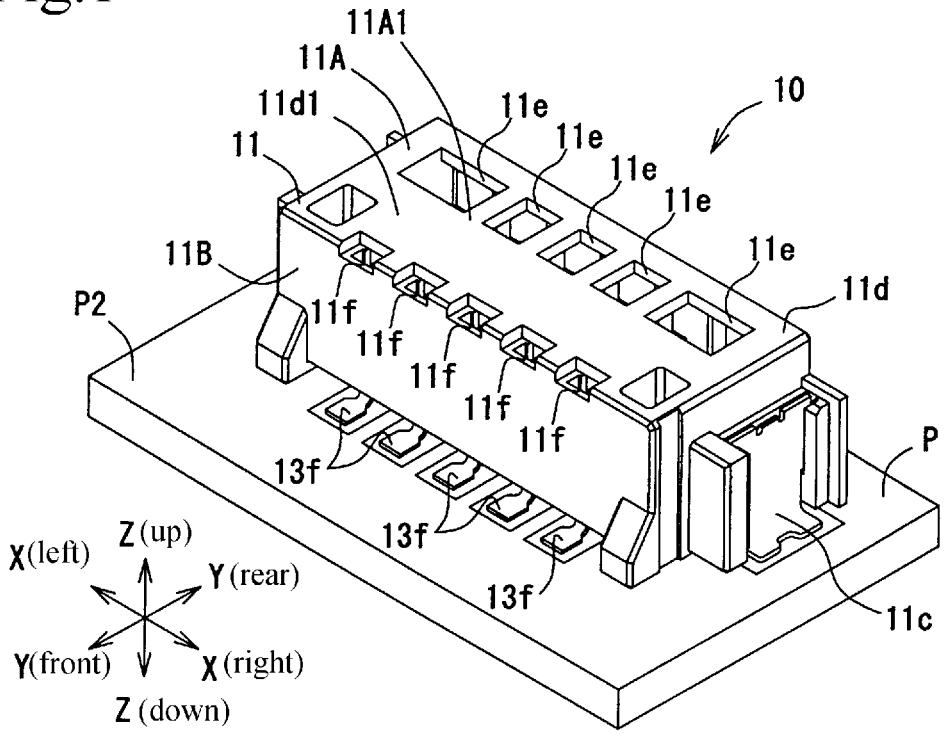
FIG. 1 is a perspective view illustrating a mounted state of a connector according to an embodiment, including a front surface, a top surface, and a right side surface.
Figure 2:
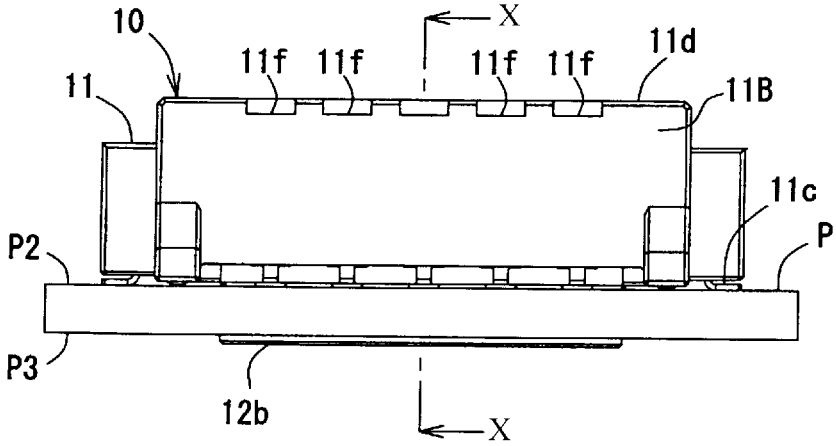
FIG. 2 is a front view of the connector of FIG. 1.
Figure 10:
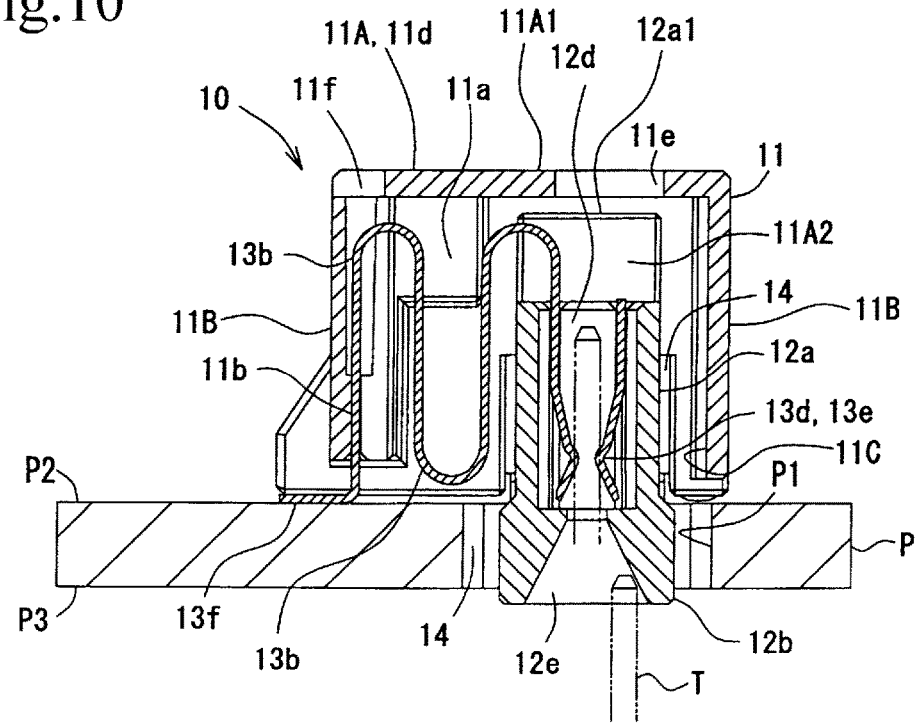
FIG. 10 is an enlarged cross-sectional view of the connector of FIG. 1, taken along line X-X of FIG. 2.

In the specification, the claims, and the drawings of the present application, the widthwise direction of the connector 10 illustrated in FIG. 1 is referred to as an X-direction, and the right side and the left side of FIG. 1 are referred to as a "right side" and a "left side", respectively. Similarly, the front-rear direction is referred to as a Y-direction, and the front side and the rear side of FIG. 10 are referred to as a "front side" and a "rear side", respectively. The height direction of the connector 10 is referred to as a Z-direction, and the top surface side and the bottom surface side are referred to as an "upper" side and a "lower" side, respectively. However, such definitions of right, left, upper, lower, front, and rear sides do not limit the mounting direction and use direction of the connector of the present invention. Further, in the description of the embodiment, pin terminals T of a pin header will be given as an example of a "connection object."

Embodiment (FIGS. 1 to 13)

The connector 10 includes a fixed housing 11 serving as an "outer housing", a movable housing 12 serving as an "inner housing", and a plurality of terminals 13.

Figure 9:
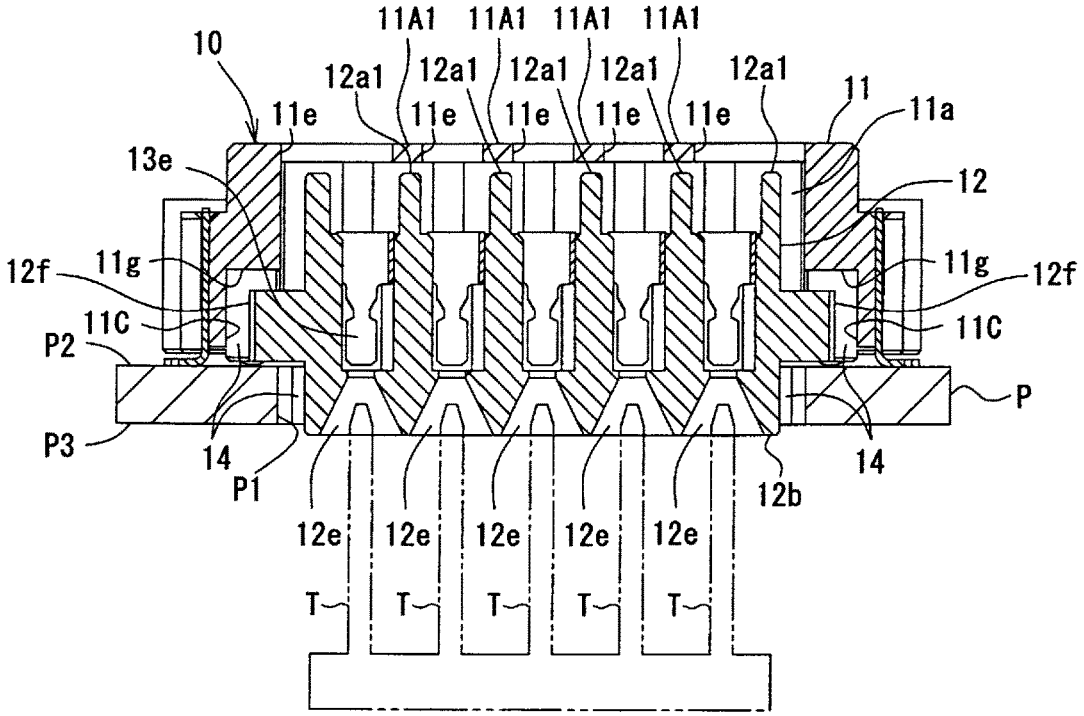
FIG. 9 is a cross-sectional view of the connector of FIG. 1, taken along line VIII-VIII of FIG. 3.
Figure 11:
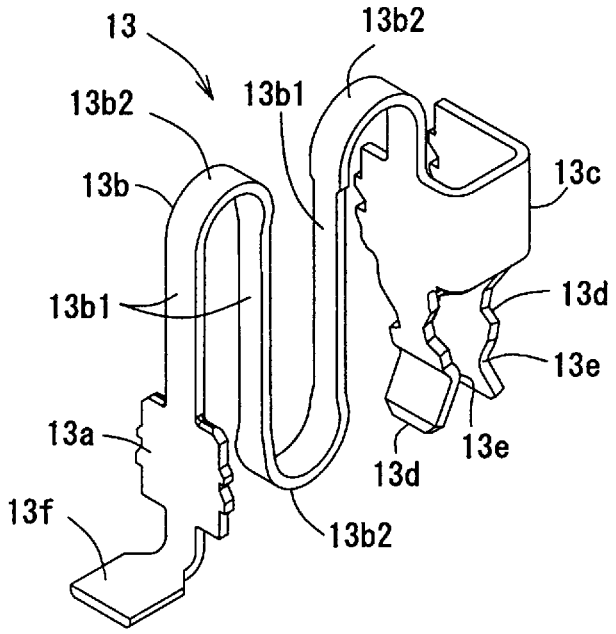
FIG. 11 is a perspective view of a terminal in the connector of FIG. 1.
Figure 12:
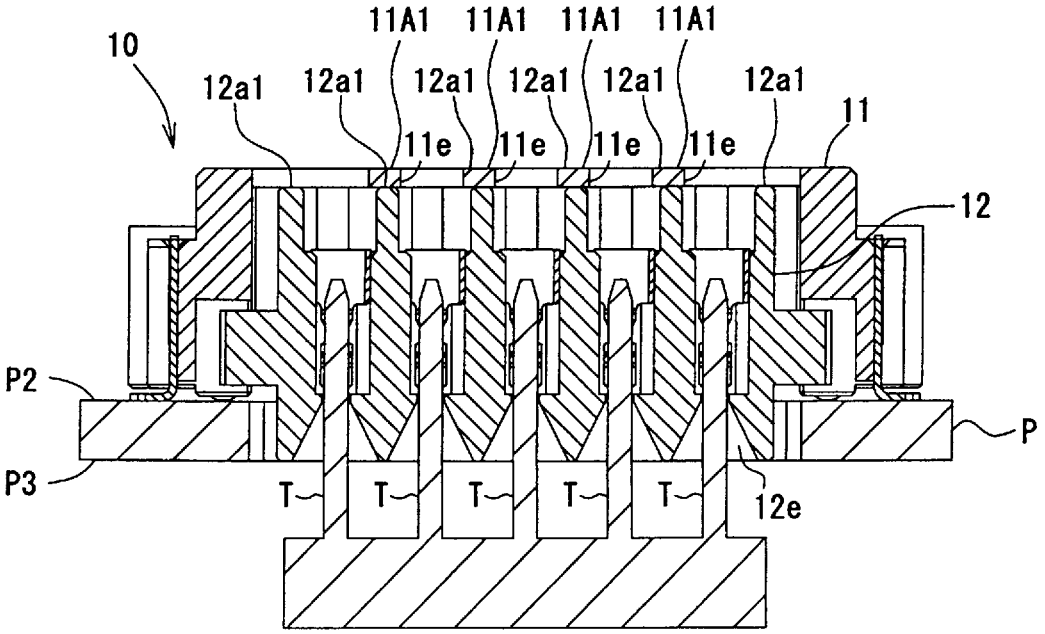
FIG. 12 is an enlarged cross-sectional view, taken along line VIII-VIII of FIG. 3, illustrating a fitting and insertion process for a connection object subsequent to the state of FIG. 9.
Figure 13:
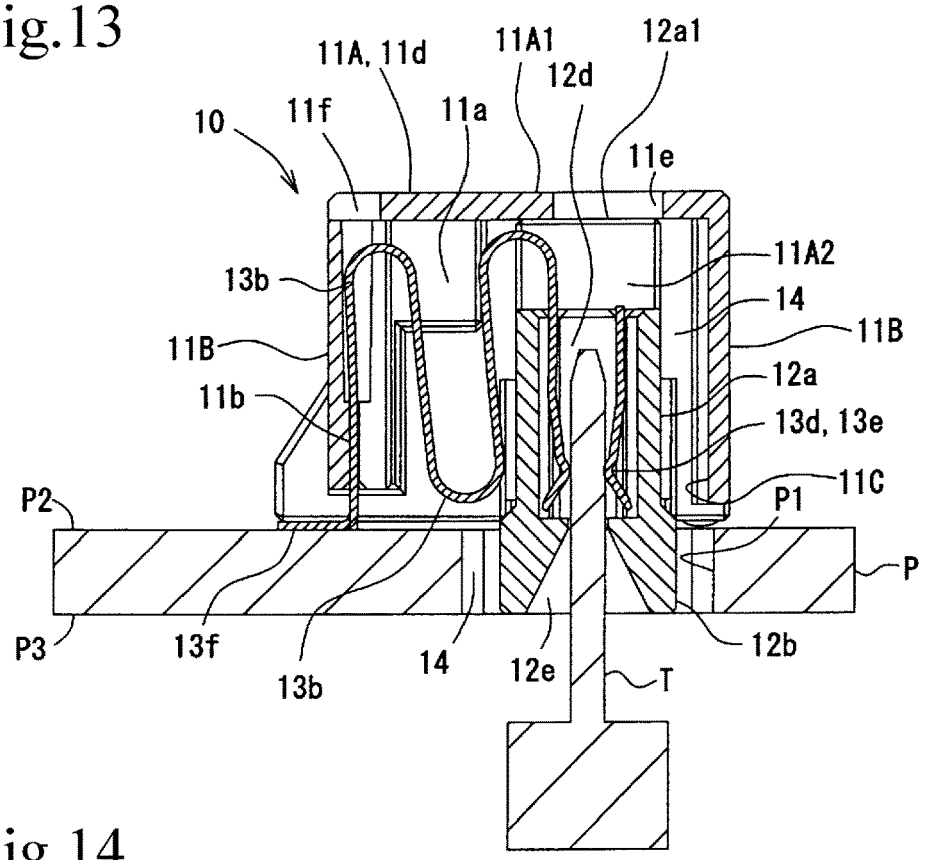
FIG. 13 is an enlarged cross-sectional view, taken along line X-X of FIG. 2, illustrating the fitting and insertion process for the connection object subsequent to the state of FIG. 10.

The fixed housing 11 is formed by a molded body of synthetic resin, and its inner portion is shaped like a hollow box. The fixed housing 11 has an upper wall 11A and a peripheral wall 11B, and has a recessed shape. The upper wall 11A at one end of the peripheral wall 11B forms "an opposed wall" or "a wall that forms a bottom surface of a recessed receiving chamber" of the present invention, and an inner surface of the upper wall 11A forms "a bottom surface" of a receiving chamber 11*a* to be described later. On a side opposite from the upper wall 11A, that is, at the other end of the peripheral wall 11B, an opening 11C in which the movable housing 12 is inserted is provided. As illustrated in FIGS. 9 and 10, a receiving chamber 11*a* is provided inside the fixed housing 11, and the movable housing 12 is disposed therein. The fixed housing 11 has a fixing portion 11*b* in which terminals 13 are press-fitted and attached (FIG. 10), and fixing pieces 13*a* of the terminals 13 illustrated in FIG. 11 are fixed in the fixing portion 11*b*. Both side surfaces of the fixed housing 11 in the width direction X are provided with their respective fixing metals 11*c*, and the fixed housing 11 is fixed to a substrate P by the fixing metals 11*c*.

First holes lie corresponding to the terminals 13 are open in the upper wall 11A of the fixed housing 11. The fitting/insertion state of pin terminals T serving as a connection object can be visually checked from the outside through the first holes 11*e*. The upper wall 11A of the fixed housing 11 also has second holes 11*f*. Below the second holes 11*f*, spring portions 13*b* of the terminals 13 to be described later are located. The second holes 11*f* and the above-described first holes 11*e* can function as heat radiation windows from which heat generated by the terminals 13 is dissipated to the outside of the fixed housing 11. Therefore, the connector 10 can cope with the use of a large current.

Figure 3:
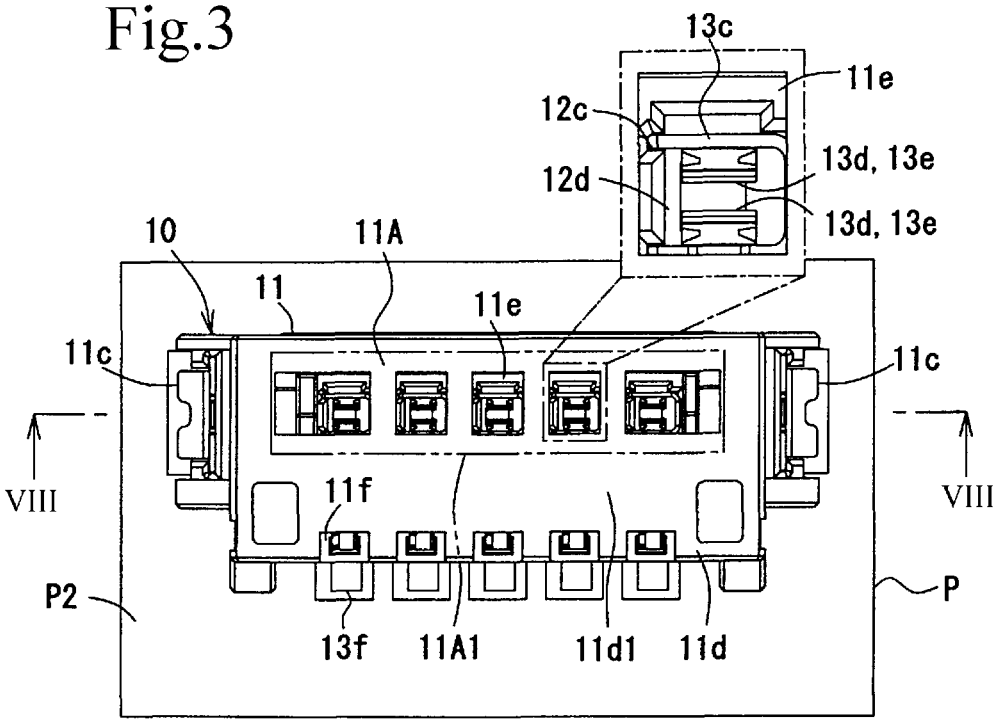
FIG. 3 is a plan view of the connector of FIG. 1.

An abutment receiving portion 11A1 is provided in an area of the upper wall 11A shown by a two-dot chain line in FIG. 3. The abutment receiving portion 11A1 is a part of the upper wall 11A having a contact surface on which abutment portions 12*a*1 of the movable housing 12 to be described later abut when the connection object is fitted and inserted. Therefore, the abutment receiving portion 11A1 is provided to cover the displacement amount of the movable housing 12. That is, the abutment receiving portion 11A1 has the contact surface with the length and width that allow abutment of the abutment portions 12*a*1 even when the movable housing 12 is displaced and deviates in the width direction X and the front-rear direction Y.

On an upper surface 11*d* of the upper wall 11A, a flat surface 11*d*1 is provided along the width direction X at almost the center position in the front-rear direction Y. The flat surface 11*d*1 serves as a sucked portion to be sucked by a suction nozzle during automatic mounting. Therefore, the connector 10 of the embodiment copes with automatic mounting.

A gap 14 is provided between the fixed housing 11 and the movable housing 12 disposed in the fixed housing 11, as illustrated in FIGS. 9 and 10. The gap 14 serves as a space in which the movable housing 12 elastically supported in a floating state by the spring portions 13*b* of the terminals 13 can be displaced in the width direction X, the front-rear direction Y, and the height direction Z.

Figure 6:
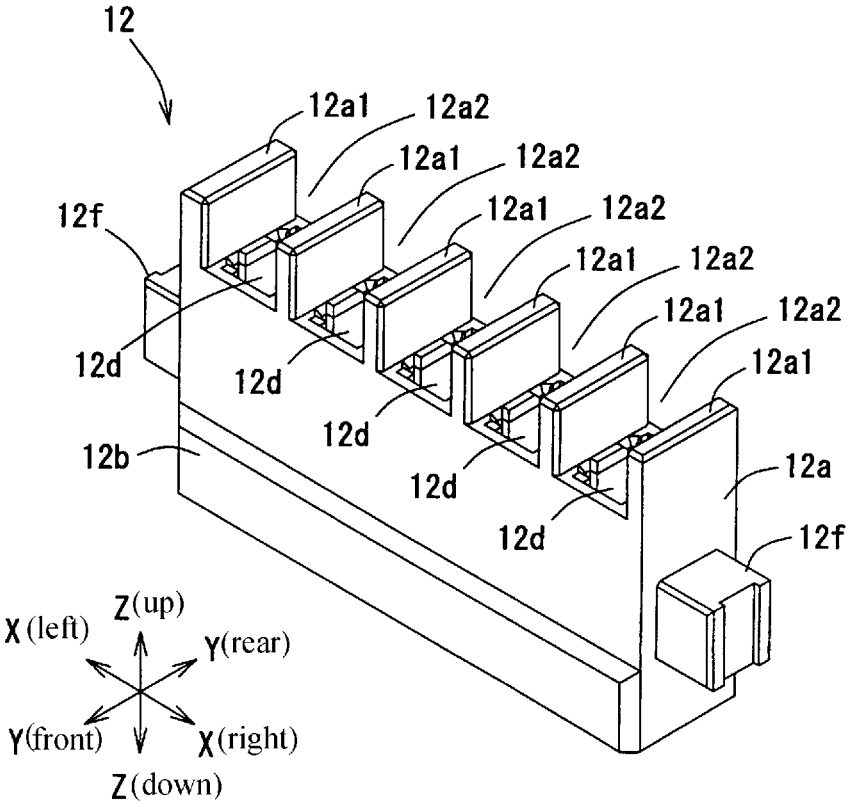
FIG. 6 is a perspective view of a movable housing in the connector of FIG. 1, including a front surface, a top surface, and a right side surface.
Figure 7:
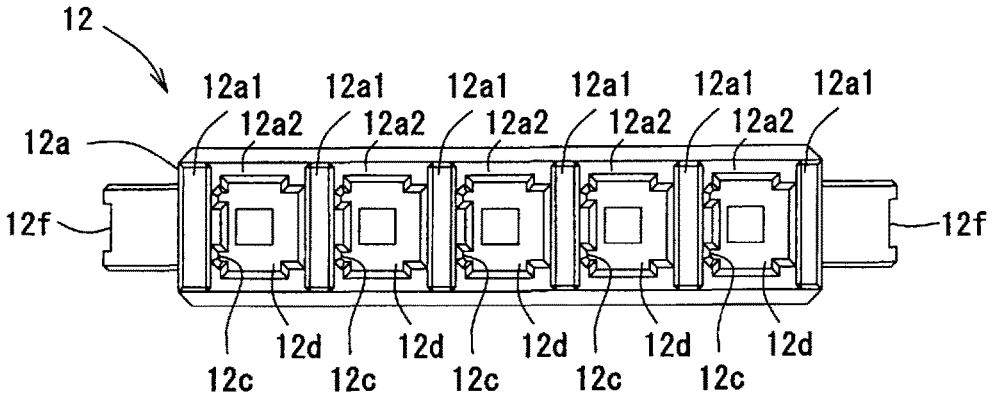
FIG. 7 is a plan view of the movable housing of FIG. 6.
Figure 8:
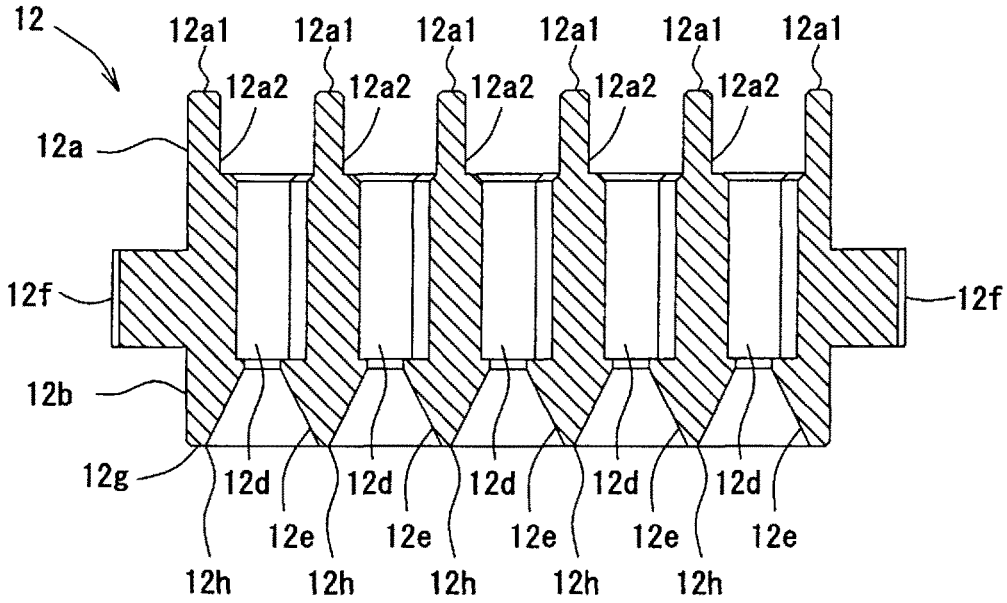
FIG. 8 is a cross-sectional view of the movable housing of FIG. 6, taken along line VIII-VIII of FIG. 3.

As illustrated in FIG. 6, the movable housing 12 includes a housing body 12*a* and a protruding portion 12*b*. The housing body 12*a* is disposed on one surface P2 of the substrate P, and has a plurality of abutment portions 12*a*1. In the embodiment, the abutment portions 12*a*1 are provided at a plurality of positions in the arrangement direction of the terminals 13 (width direction X). Six abutment portions 12*a*1 are provided, that is, four abutment portions 12*a*1 are located between adjacent terminal holding portions 12*d* to be described later, and two abutment portions 12*a*1 are located at opposite ends of the housing body 12*a* in the width direction X. The abutment portions 12*a*1 are located at a distal end of the movable housing 12 in the inserting and fitting direction when the pin terminals T serving as the connection object are fitted and inserted. The abutment portions 12*a*1 abut on the abutment receiving portion 11A1 to stop upward displacement of the movable housing 12 (inserting and fitting direction) in the height direction Z.

In the embodiment, the abutment portions 12*a*1 are provided as projecting walls 12*a*1 each shaped like a thin plate to separate the adjacent terminal holding portions 12*d*. The length of the projecting walls 12*a*1 is more than the aperture width of the first holes 11*e* in the fixed housing 11 so that the projecting walls 12*a*1 are not caught inside the first holes 11*e*. Between the adjacent projecting walls 12*a*1, that is, at positions on extensions of the terminal holding portions 12*d*, heat radiation passages 12*a*2 are provided to dissipate heat generated by contact portions 13*e*. Since the projecting walls 12*a*1 are located between the adjacent terminals 13, insulation performance between the terminals 13 is enhanced, and this increases the withstand voltage of the movable connector 10. The movable connector 10 can also cope with the use of a large current in this respect.

The protruding portion 12*b* projects from the housing body 12*a*. In the embodiment, the protruding portion 12*b* protrudes from the other surface P3 of the substrate P through a through hole P1 of the substrate P.

As illustrated in an enlarged manner in FIG. 3, the housing body 12*a* includes fixing portions 12*c* that fix base portions 13*c* of the terminals 13, and terminal holding portions 12*d* that receive spring pieces 13*d* extending from the base portions 13*c*. The terminal holding portions 12*d* are provided as through holes extending in the height direction Z in correspondence with the terminals 13. Upper ends of the terminal holding portions 12*d* are open to be opposed to the first holes 11*e* of the fixed housing 11, and lower ends of the terminal holding portions 12*d* communicate with insertion holes 12*e* for pin terminals T. When the pin terminals T are inserted in the terminal holding portions 12*d* through the insertion holes 12*e*, as shown by a two-dot chain line in FIG. 10, they come into pressure contact with the contact portions 13*e* of the spring pieces 13*d* located inside the terminal holding portions 12*d*. The adjacent terminal holding portions 12*d* and the base portions 13*c* and the spring pieces 13*d* of the terminals 13 received in the terminal holding portions 12*d* are electrically insulated by partition walls of the housing body 12*a*.

Both side surfaces of the housing body 12*a* in the width direction X are provided with their respective projecting portions 12*f*. As illustrated in FIG. 9, the projecting portions 12*f* are opposed to stepped abutment recesses 11*g* provided in inner side surfaces of the receiving chamber 11*a* of the fixed housing 11. When the movable housing 12 is displaced, the projecting portions 12*f* abut on the abutment recesses 11*g* to restrict excessive displacement of the movable housing 12 in the width direction X and the front-rear direction Y. On the lower side in the height direction Z, the projecting portions 12*f* abut on one surface P2 of the substrate P to stop excessive displacement of the movable housing 12 in the removing direction of the pin terminals T.

A distal end of the protruding portion 12*b* of the movable housing 12 is located inside the through hole P1 of the substrate P. The gap in the width direction X and the gap in the front-rear direction Y between the protruding portion 12*b* and the through hole P1 serve as the gap 14 of the fixed housing 11 in the through hole P1. Thus, the movable housing 12 does not abut on a hole surface of the through hole P1 even when it is maximally displaced in the width direction X and the front-rear direction Y. The protruding portion 12*b* has insertion holes 12*e* for the pin terminals T, and upper ends of the insertion holes 12*e* communicate with the terminal holding portions 12*d*. The insertion holes 12*e* are each formed as an inclined surface, specifically, as a hole shaped like a polygonal pyramid to properly guide insertion of the pin terminals T even when the center axes of the pin terminals T deviate.

Figure 4:
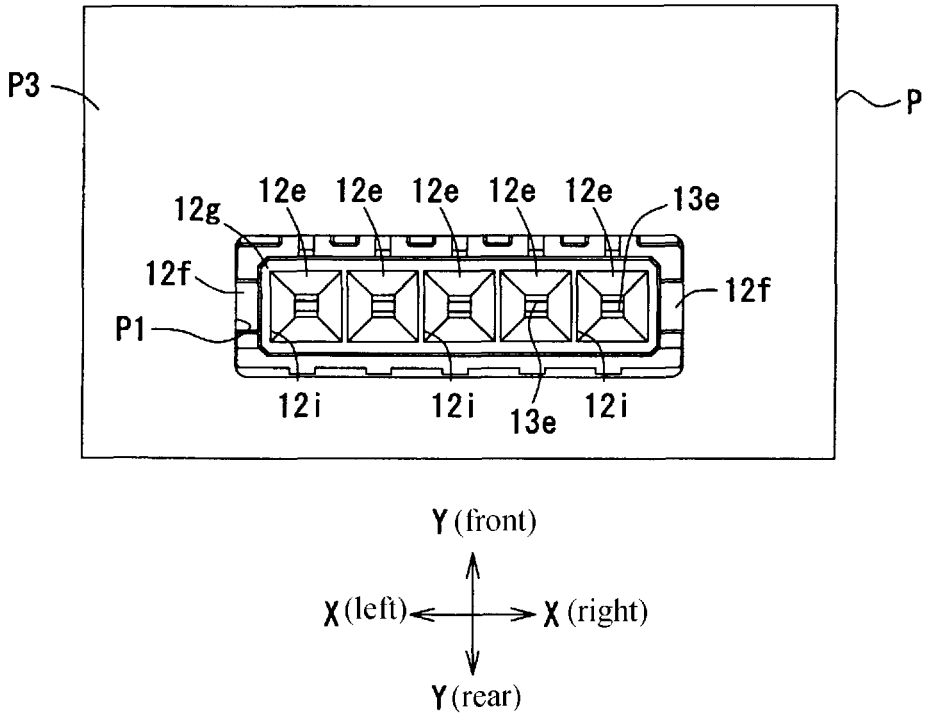
FIG. 4 is a bottom view of the connector of FIG. 1.
Figure 5:
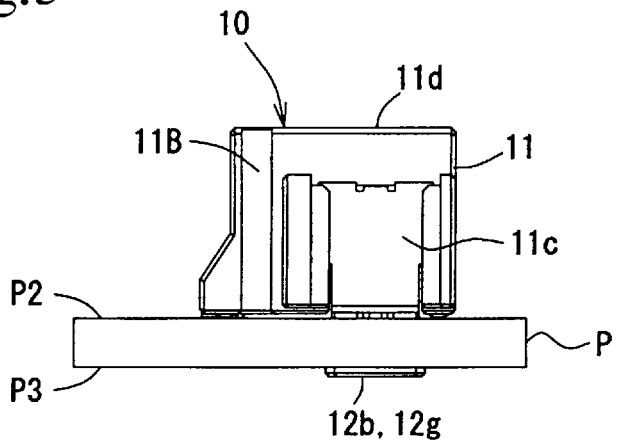
FIG. 5 is a right side view of the connector of FIG. 1.

As illustrated in FIG. 4, the insertion holes 12*e* have a size such as to occupy the entire bottom surface 12*g* of the movable housing 12 in the front-rear direction Y. Hole edges 12*h* of the insertion holes 12*e* are provided at positions facing an outer edge of the bottom surface 12*g* of the movable housing 12. This allows the pin terminals T to be properly inserted even when the center axes of the pin terminals T greatly deviate beyond the moving limit of the movable housing 12.

Each of the terminals 13 includes, in order from an attachment side to the fixed housing 11 toward an attachment side to the movable housing 12, a substrate connecting portion 13*f* soldered to the one surface P2 of the substrate P, a fixed piece 13*a* attached to the fixed housing 11, a spring portion 13*b* extending from the fixed piece 13*a* to a base portion 13*c* to elastically support the movable housing 12, a base portions 13*c* fixed to the movable housing 12, elastic arms 13*d* serving as spring pieces extending from the base portions 13*c*, and contact portions 13*e* to be in conductive contact with a pin terminal T.

The spring portion 13*b* is formed by alternately combining linear portions 13*b*1 and U-shaped bent portions 13*b*2. The width of the linear portions 13*b*1 is smaller than that of the bent portions 13*b*2. The width of the linear portions 13*b*1 is made small so that the spring portion 13*b* can be displaced softly. From the viewpoint of soft elastic deformation of the spring portion 13*b*, it is conceivable to make the entire spring portion 13*b* narrow like the linear portions 13*b*1. In this case, however, stress may concentrate at the bent portions 13*b*2 when the spring portion 13*b* elastically deforms, and this may break the spring portion 13*b*. Accordingly, flexibility of the spring portion 13*b* is enhanced by narrowing the linear portions 13*b*1, and the bent portions 13*b* are made unlikely to break and durability of the spring portion 13*b* is increased by widening the bent portions 13*b*2.

Here, the characteristics of the connector 10 having these terminals 13 will be described. The contact portions 13*e* are in pressure contact with the connection object to exert contact holding force for the corresponding pin terminal T. The contact holding force is set to be larger than the displacement load on the spring portion 13*b* such that the contact portions 13*e* deviate relative to the pin terminal T in the inserting or removing direction of the pin terminal T. From a different viewpoint, the contact holding force is set to be larger than the displacement load acting on the spring portion 13*b* when the displacement amount of the spring portion 13*b* reaches the maximum displacement amount corresponding to the moving limit of the movable housing 12. That is, while the holding force of the contact portions 13*e* for the pin terminal T is large, the displacement load needed to move the spring portion 13*b* can be made small, and the movable housing 12 can be displaced easily. Therefore, even when the movable housing 12 is displaced to the moving limit in the X-direction, the Y-direction, and the Z-direction, since the contact portions 13*e* have the holding force larger than the displacement load of the spring portion 13*b*, they does not cause fretting on the pin terminal T and continue to maintain the initial contact position even in the height direction Z in which the contact portions 13*e* easily slip and deviate relative to the pin terminal T. Since such fretting of the contact portions 13*e* due to displacement of the movable housing 12 can be prevented, troubles, such as peeling of plating from the pin terminal T and generation of shavings of the pin terminal T, can be reduced. Thus, even the movable connector 10 can maintain high connection reliability from the beginning of fitting.

[Method for Mounting Connector 10 on Substrate P]

To mount the above-described connector 10 on the substrate P, the protruding portion 12*b* of the movable housing 12 is inserted through the through hole P1 of the substrate P, and the fixed housing 11 is placed at a predetermined mounting position on the substrate P. When the connector 10 is transferred, it can be automatically mounted by using the flat surface 11*d*1 on the upper surface 11*d* of the fixed housing 11 as a sucked portion. Then, the fixing metals 11*c* and the substrate connecting portions 13*f* of the terminals 13 are fixed by soldering. Thus, the connector 10 is mounted on the substrate P so that the protruding portion 12*b* of the movable housing 12 protrudes from the other surface P3 of the substrate P.

[Operational Advantages of Connector 10]

Next, operational advantages of the connector 10 of the embodiment other than the above-described ones will be described.

When the pin terminals T are connected to the connector 10, they are inserted in the insertion holes 12*e* of the protruding portion 12*b* of the movable housing 12. In the connector 10, the pin terminals T can be reliably guided to the contact portions 13*e* by being introduced by the large-aperture inclined surfaces of the insertion holes 12*e* with a large introduction amount.

When insertion of the pin terminals T is continued, the pin terminals T abut on the contact portions 13*e* of the terminals 13, and stretch the contact portions 13*e* out. By the action of this insertion force, the movable housing 12 is displaced in the inserting and fitting direction along the height direction Z, and the plural abutment portions 12*a*1 at the distal end of the movable housing 12 abut on the abutment receiving portion 11A1 of the upper wall 11A in the fixed housing 11. Therefore, the movable housing 12 can stably maintain its right posture without obliquely tilting. This allows the pin terminals T to be inserted properly.

At this time, the projecting portions 12*f* of the movable housing 12 are not in contact with the abutment recesses 11*g* of the fixed housing 11, and the operating force for pushing in the pin terminals T is received by the plural abutment parts between the abutment portions 12*a*1 at the distal end of the movable housing 12 and the abutment receiving portion 11A1. This prevents the movable housing 12 from being curved and deformed in an arcuate form, and suppresses the occurrence of trouble such that the spring portions 13*b* of the terminals 13 in the center portion of the movable housing 12 are slightly stretched from the beginning of fitting of the pin terminals T and the load is constantly applied thereto. Hence, according to the connector 10 of the embodiment, the load generated in the spring portions 13*b* resulting from displacement of the movable housing 12 can be uniformly distributed to the spring portions 13*b* of all the terminals 13. Consequently, both high flexibility and high fatigue durability in the spring portions 13*b* can be continuously achieved, and connection reliability can be enhanced.

Modifications of Embodiment (FIGS. 14 to 17)

Since the connector 10 of the above-described embodiment can be carried out by various modifications, some modifications will be described.

Figure 14:
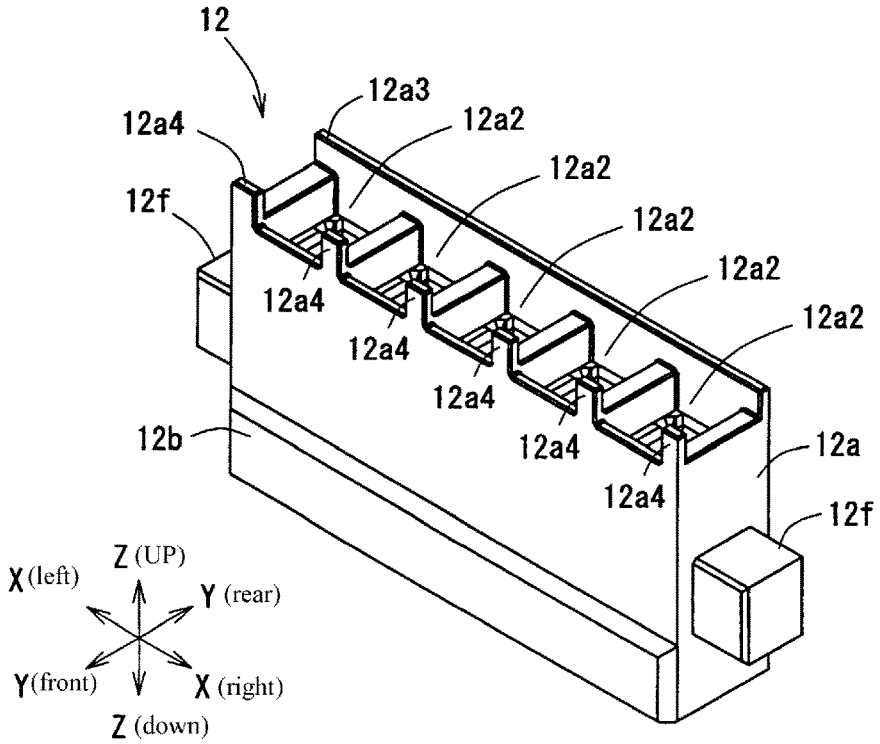
FIG. 14 is a perspective view illustrating a modification of a movable housing.
Figure 15:
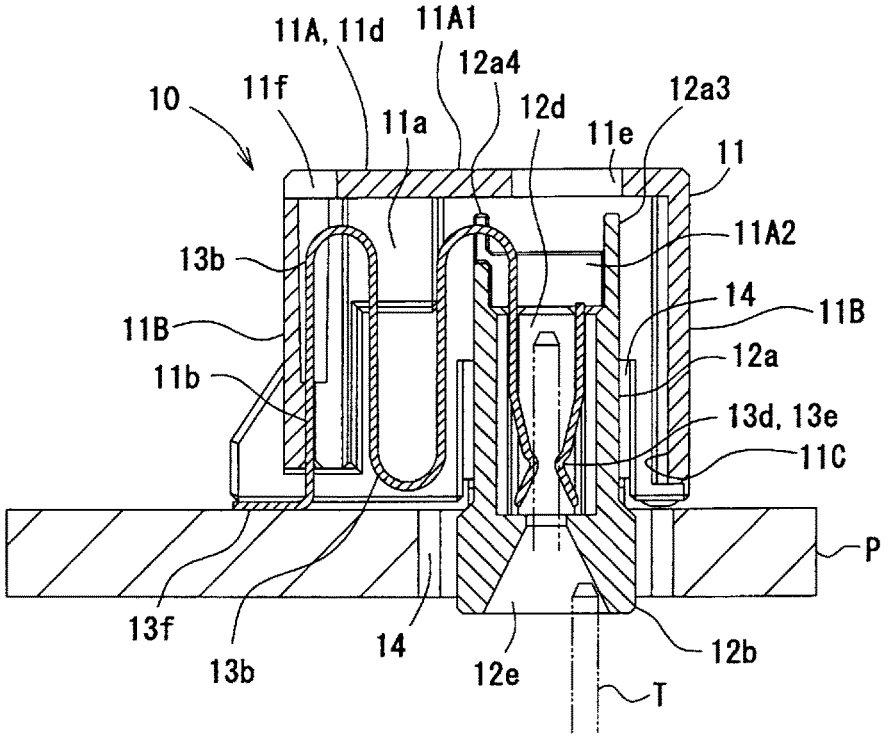
FIG. 15 is an enlarged cross-sectional view of a connector including the movable housing of FIG. 14, corresponding to FIG. 10.

While the abutment portions (projecting walls) 12*a*1 are provided between the adjacent terminal holding portions 12*d* in the above embodiment, for example, as illustrated in FIGS. 14 and 15, an abutment portion (projecting wall) 12*a*3 having a length along the width direction X of the movable housing 12 and columnar abutment portions (projecting walls) 12*a*4 provided between the adjacent terminal holding portions 12*d* may be used. All of these abutment portions 12*a*3 and 12*a*4 have the same height. Either the contact portion 12*a*3 or the contact portions 12*a*4 may be provided.

Figure 16:
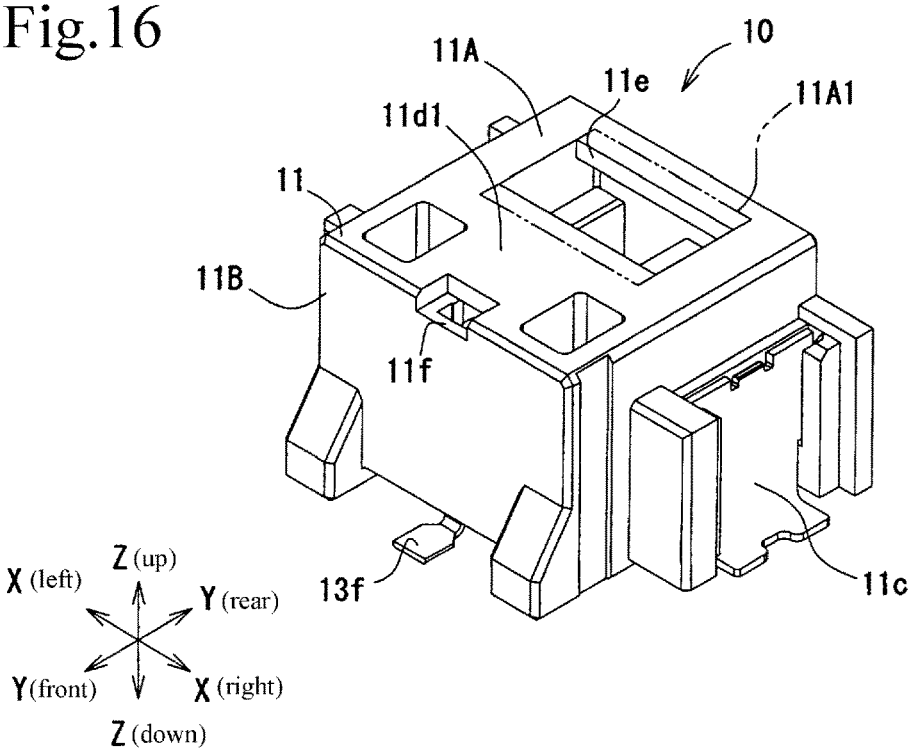
FIG. 16 is a perspective view illustrating a modification of a connector.
Figure 17:
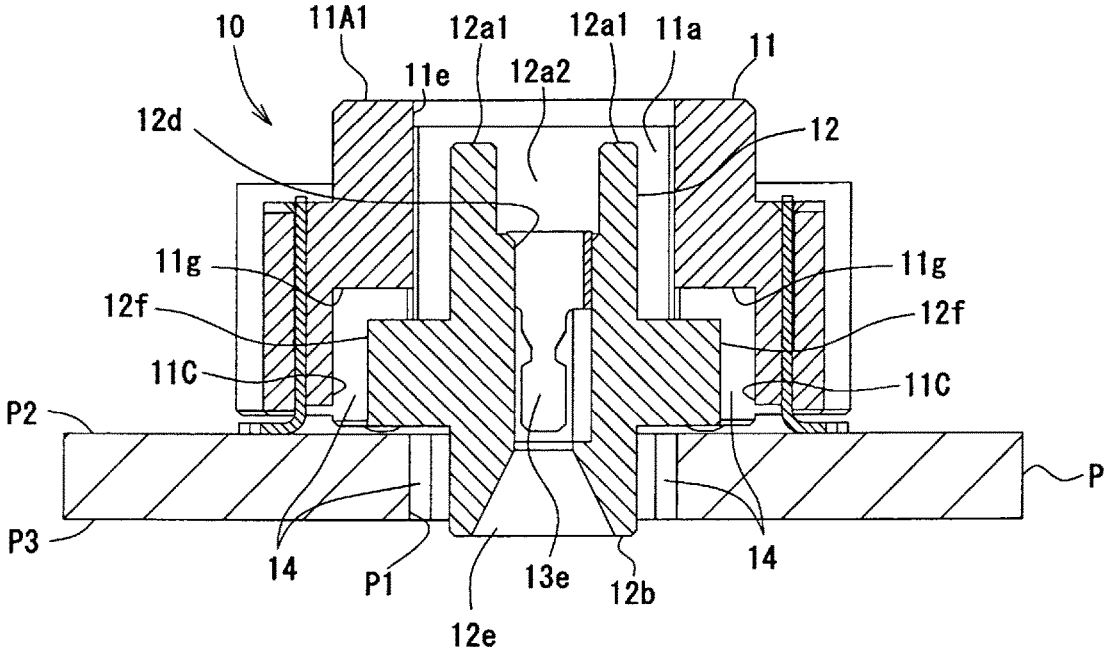
FIG. 17 is an enlarged cross-sectional view of the connector of FIG. 16, corresponding to FIG. 9.

While the connector 10 of the embodiment is the multipolar connector having a plurality of terminals 13, for example, as illustrated in FIGS. 16 and 17, the connector 10 may have one terminal 13. Even in such a monopolar connector 10, when a pin terminal T is fitted and inserted, two abutment portions 12*a*1 at a distal end of a movable housing 12 in the displacement direction abut on an abutment receiving portion 11A1 of the fixed housing 11. Thus, the movable housing 12 does not tilt, but maintains a stable posture. This allows the pin terminal T to be properly brought into conductive connection to contact portions 13*e*. Operational advantages similar to those of the embodiment can be obtained besides.

While the connector 10 of the above embodiment has five terminals, arcuate curved deformation becomes more likely to occur during fitting and insertion of the pin terminals T as the number of terminals increases and the length of the movable housing 12 increases. Hence, the number of terminals may exceed five.

While the projecting walls 12*a*1 each shaped like a thin plate are provided as the abutment portions 12*a*1 in the above embodiment, an end surface of the housing body 12*a* in which the terminal holding portions 12*d* are open may serve as an abutment portion without providing the projecting walls 12*a*1. In this case, however, since the heat radiation passages 12*a*2 cannot be formed, heat radiation performance of the connector deteriorates, and withstand voltage performance also deteriorates.

While the protruding portion 12*b* of the movable housing 12 has a length such as to slightly protrude from the other surface P3 of the substrate P in the above embodiment, it may have a length such as to protrude more. This can restrict the pin terminals T from being inserted between the protruding portion 12*b* and the through hole P1 without entering the insertion holes 12*e*. Further, while the insertion holes 12*e* are provided as inclined surfaces in the hole axis direction in the above embodiment, inclined conical holes and uninclined linear holes may be combined.

While displacement of the movable housing 12 in the removing direction of the pin terminals T is stopped by abutment of the projecting portions 12*f* on the one surface P2 of the substrate P in the above embodiment, it may be stopped by providing the fixed housing 11 with portions to abut on the projecting portions 12*f* of the movable housing 12 so that the projecting portions 12*f* do not abut on the substrate P.

What is claimed is:

1. A movable connector comprising:

an outer housing having a peripheral wall and an upper wall positioned at one side of the peripheral wall and further having a receiving chamber therein;

an inner housing disposed in the receiving chamber and having an insertion hole for a connection object; and at least one terminal having a spring portion that supports the inner housing displaceably relative to the outer housing, wherein the inner housing has at least one abutment portion opposed to the upper wall in a distal end portion thereof in an inserting and fitting direction of the connection object, and wherein the upper wall of the outer housing is opposed to the at least one abutment portion, and the upper wall has an abutment receiving portion on which the at least one abutment portion abuts when the connection object is inserted.

2. The movable connector according to claim 1, wherein the outer housing has a recessed shape in which the receiving chamber is provided, and wherein the upper wall is a wall that forms a bottom surface of the recessed receiving chamber.

3. The movable connector according to claim 1, wherein the at least one abutment portion of the inner housing includes a plurality of abutment portions spaced from each other.

4. The movable connector according to claim 1, wherein the at least one terminal includes a plurality of terminals.

5. The movable connector according to claim 1, wherein the abutment receiving portion has a contact surface on which the at least one abutment portion abuts even when the inner housing is displaced and deviates.

6. The movable connector according to claim 1, wherein the outer housing has a flat surface on an outer surface of the upper wall.

7. The movable connector according to claim 1, wherein the at least one abutment portion is provided as a projecting wall having a length along an arrangement direction of the at least one terminal.

8. The movable connector according to claim 1, wherein the at least one abutment portion is provided as projecting walls at a plurality of positions in an arrangement direction of the at least one terminal.

9. The movable connector according to claim 7, wherein the inner housing has at least one terminal holding portion, and wherein the projecting wall is located adjacent to the terminal holding portion.

10. The movable connector according to claim 8, wherein the inner housing has at least one terminal holding portion, and wherein the projecting walls are located adjacent to the at least terminal holding portion.

11. The movable connector according to claim 9, wherein the at least one terminal holding portion includes a plurality of terminal holding portions, and the projecting wall is provided between the adjacent terminal holding portions.

12. The movable connector according to claim 10, wherein the at least one terminal holding portion includes a plurality of terminal holding portions, and the projecting walls are provided between the adjacent terminal holding portions.

13. A movable connector comprising:

an outer housing having a receiving chamber therein;

an inner housing disposed in the receiving chamber and having an insertion hole for a connection object; and at least one terminal having a spring portion that supports the inner housing displaceably relative to the outer housing, wherein the inner housing has at least one abutment portion in a distal end portion thereof in an inserting and fitting direction of the connection object, and wherein the outer housing has an opposed wall opposed to the at least one abutment portion, and the opposed wall has an abutment receiving portion on which the at least one abutment portion abuts when the connection object is inserted, wherein the inner housing has a hole-shaped terminal holding portion, and wherein the outer housing has a hole at a position on an extension of the terminal holding portion of the inner housing.

* * * * *